US006919691B2

(12) United States Patent
Mizukoshi et al.

(10) Patent No.: US 6,919,691 B2
(45) Date of Patent: Jul. 19, 2005

(54) ORGANIC EL DISPLAY DEVICE WITH GAMMA CORRECTION

(75) Inventors: Seiichi Mizukoshi, Kanagawa (JP); Nobuyuki Mori, Saitama (JP); Kouichi Onomura, Kanagawa (JP)

(73) Assignee: Eastman Kodak Company, Rochester, NY (US)

( * ) Notice: Subject to any disclaimer, the term of this patent is extended or adjusted under 35 U.S.C. 154(b) by 37 days.

(21) Appl. No.: 10/629,488

(22) Filed: Jul. 29, 2003

(65) Prior Publication Data

US 2005/0023986 A1 Feb. 3, 2005

(30) Foreign Application Priority Data

Oct. 17, 2002 (JP) ..... 2002-303576

(51) Int. Cl.[7] ..... G09G 3/30

(52) U.S. Cl. ..... 315/169.1; 315/169.3; 345/76; 345/77

(58) Field of Search ..... 315/169.3, 169.1; 345/76, 77

(56) References Cited

U.S. PATENT DOCUMENTS 6,646,625 B1 * 11/2003 Shigeta et al. ..... 345/63
6,762,744 B2 * 7/2004 Katase ..... 345/107

* cited by examiner

*Primary Examiner*—David Vu
(74) *Attorney, Agent, or Firm*—Raymond L. Owens

(57) ABSTRACT

An organic EL display device which displays by individually controlling an amount of current of organic EL elements, which are arranged in a matrix, according to an input image signal, comprising:

a lookup table for storing gamma compensation data for compensating an image signal;

storage means for storing an equation for performing gamma compensation of the input image signal; and table data generation means for generating table lookup data and storing such data in the lookup table on the basis of the equation stored in the storage means, and wherein the table data generated by the table data generation means is stored in the lookup table by an initialization operation to perform gamma compensation of the input image signal.

5 Claims, 7 Drawing Sheets

ORGANIC EL DISPLAY DEVICE WITH GAMMA CORRECTION

FIELD OF THE INVENTION

The present invention relates to an organic EL display device which individually performs an initialization gamma adjustment for input signal which controls the EL display device.

BACKGROUND OF THE INVENTION

Organic EL display devices have organic EL elements and are arranged in a matrix as pixels and individually controls the emission of the organic EL elements of the respective pixels to make display. Organic EL display devices include an active type and a passive type. The active type organic EL display device, has associated with each pixel, a pixel, a drive circuit for controlling current through the corresponding organic EL element. Active matrix types of drives are better for high definition display.

FIG. 1 shows an example of the pixel circuit of an active type organic EL display device. A drive TFT 1 is a p-channel type and has a source connected to a power supply PVdd which extends in a vertical direction and a drain connected to an anode of an organic EL element 2. A cathode of the organic EL element 2 is connected to a cathode power supply CV.

A gate of the drive TFT 1 is connected to a source of an n-channel type selection TFT 3. A drain of the selection transistor is connected to a data line Data which extends in a vertical direction, and a gate thereof is connected to a gate line Gate which extends in a horizontal direction. The gate of the drive TFT 1 is also connected to one end of a retention capacitor C, the other end of which is connected to a capacitor power supply Vsc.

Thus, the selection TFT 3 is turned on when the gate line Gate is set to a high level. At this time, when an image signal representing luminance of the pixel is applied to the data line Data, a voltage of the image signal is held in the retention capacitor C and applied to the gate of the drive TFT 1. Therefore, a gate voltage of the drive TFT 1 is controlled by the image signal, and the current flowing to the organic EL elements 2 is controlled. The gate voltage of the drive TFT 1 is held by virtue of the retention capacitor C even after the selection TFT 3 is turned off.

A luminous volume of the organic EL elements 2 is substantially proportional to its drive current. Therefore, the organic EL elements 2 emit light according to the image signal.

Here, the display device does not have a linear relationship (gamma) between the input signal level and the display luminance. Therefore, gamma compensation is performed in order to provide an appropriate relationship. To turn on the drive TFT 1 in the pixel circuit shown in FIG. 1, a gate-to-source voltage Vgs must be a prescribed threshold voltage (Vth) or more. The image signal is basically data corresponding to the luminance of emitted light, and the minimum level corresponds to the black level. Therefore, a data voltage to be supplied to the pixel circuit is required to carry out black level offset setting so to offset the image signal by a voltage corresponding to the threshold voltage Vth.

FIG. 2 shows an example of a conventional structure to perform black level offset setting and gamma compensation. Respective signals of RGB are gamma-compensated by respective gamma compensation lookup tables (LUT) 5R, 5G, 5B, converted into analog signals by D/A converters 6R, 6G, 6B and input to a display panel 7. Contents of the LUTs 5R, 5G, 5B have the table data stored in the flash memory 9 written therein by a CPU 8 before they are shown on the display panel 7.

In this example, the black level offset is adjusted by the D/A converters 6R, 6G, 6B so that a black input voltage of the display panel 7 can be output for the black signal. Since the contents of the LUT 5R, 5G, 5B are adjusted to values so that the black input voltage of the panel is output for the black signal, it is possible to omit adjustment by the D/A converters 6R, 6G, 6B.

In any event, optimum gamma table values and black level values of each color must be measured for each panel before shipping from a factory. When the TFT characteristics are substantially the same for the respective colors, the black level offset voltage value may be common to RGB.

To measure the gamma and black level offset voltage of the display panel 7, data to provide a linear input/output characteristic is written in the LUTs 5R, 5G, 5B, and the input signal is changed in this state to measure the luminance characteristic of the panel for the respective colors RGB.

A gamma compensation circuit for a display is proposed in Japanese Patent Laid-Open Publication No. Hei 6-245222 (hereinafter referred to as the patent publication 1) or the like, but it does not propose what gamma compensation is performed for the organic EL panel.

SUMMARY OF THE INVENTION

It is an object of the present invention to provide an organic EL display device which can efficiently use a lookup table.

This object is achieved by an organic EL display device which displays by individually controlling an amount of current of organic EL elements, which are arranged in a matrix, according to an input image signal, comprising:

a lookup table for storing gamma compensation data for compensating an image signal;

storage means for storing an equation for performing gamma compensation of the input image signal; and table data generation means for generating table lookup data and storing such data in the lookup table on the basis of the equation stored in the storage means, and wherein the table data generated by the table data generation means is stored in the lookup table by an initialization operation to perform gamma compensation of the input image signal.

According to the present invention described above, the table data generation means generates the table data according to data about the equation stored in the storage means and writes the date into the lookup table. Therefore, it is not necessary to store all the table data, and the storage means does not need to have a large capacity. Measurement points required to determine the equation may be fewer than those when such an equation is not used, and it becomes easy to determine at a factory or the like.

The table data generation means preferably includes a nonvolatile memory which stores a coefficient of the equation and processing means which generates the equation using the coefficient stored in the nonvolatile memory.

The equation stored in the table data storage means is preferably obtained by making the organic EL panel emit light in a luminous amount according to input image signal levels of a plurality of stages, detecting the luminous amount, determining a relationship between the input image signal level and the luminous amount, calculating an approximate expression indicating their relationship or only a prescribed coefficient of the approximate expression, and determining based on the obtained approximate expression or the coefficient.

Alternatively, the equation stored in the table data storage means is preferably obtained by measuring a drive current passed to the organic EL elements when input image signals of a plurality of stages are supplied to make the organic EL elements emit light, determining a relationship between the input image signal level and the luminous amount of the organic EL elements based on the luminous efficiency of the organic EL elements from the measured current value, calculating an approximate expression indicating a relationship between the input image signal and the luminous amount of the organic EL elements or a predetermined coefficient of the approximate expression according to the obtained result, and determining based on the obtained approximate expression or the coefficient.

According to the present invention, it is also desirable that the organic EL display device further comprises total current detection means for detecting a total current passing to all the organic EL elements arranged in a matrix, wherein an offset voltage is generated to offset the input image signal according to the total current detected by the total current detection means so as to start to pass a current to the organic EL elements to cope with the black level of the input image signal.

DESCRIPTION OF THE PREFERRED EMBODIMENTS

Figure 3:
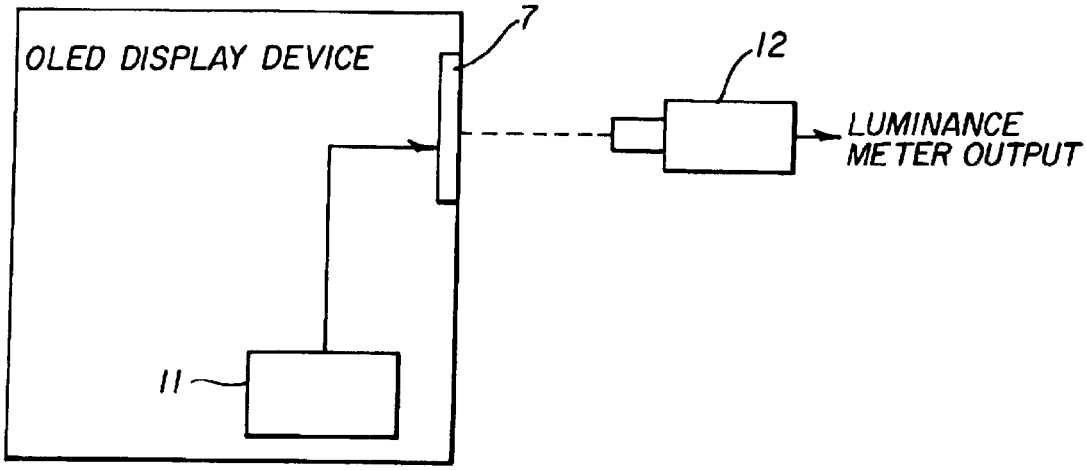
FIG. 3 is a diagram showing a luminance measuring system of a display panel.
Figure 4:
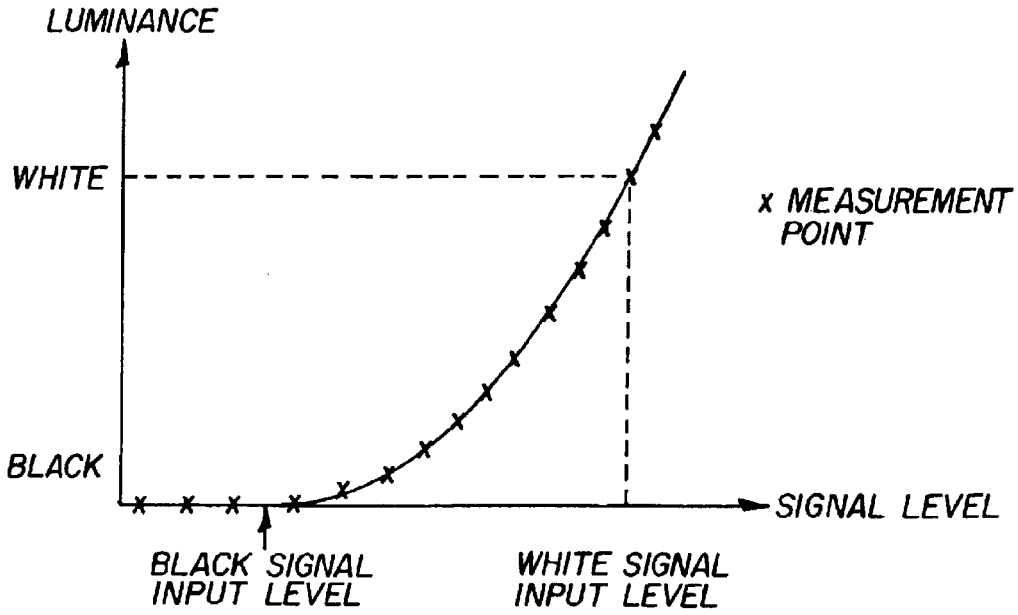
FIG. 4 is a diagram showing a relationship between a signal level and luminance.

FIG. 3 is a diagram schematically showing a measurement system. A prescribed input signal is supplied from a drive circuit 11 to the display panel 7 to emit light. A luminous amount of the display panel 7 is detected by a luminance meter 12. As described above, a relationship between the input signal level and luminance of emitted light of each color is determined with the input signal varied in a prescribed range for the respective colors RGB. Thus, a relationship between the signal level and the luminance as shown in, for example, FIG. 4 can be obtained.

Figure 5:
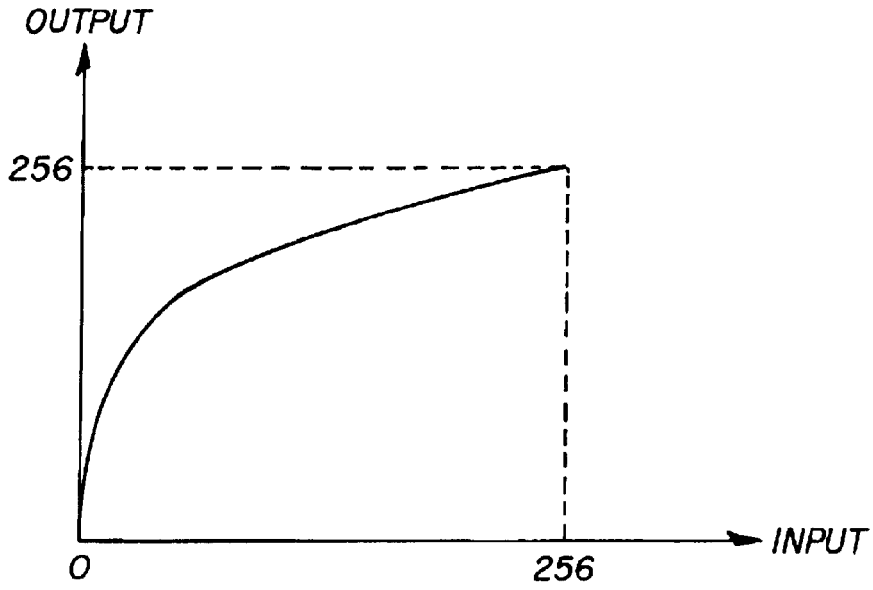
FIG. 5 is a diagram showing a relationship between input and output of a lookup table.

Thus, in the organic EL panel, a luminance increase rate becomes high as the input signal level becomes higher. Data for compensating this is written in the lookup tables. For example, data to output 0 to 255 of the vertical axis with respect to the input of image signals 0 to 255 of the horizontal axis shown in FIG. 5 is written in the lookup tables. Thus, it becomes possible to carry out the gamma compensation.

Here, the curve of FIG. 5 is a curve passing through the origin point and rising from input 0. Specifically, it is based on the premise that the black level offset is adjusted by the D/A converters 6R, 6G, 6B.

Figure 1:
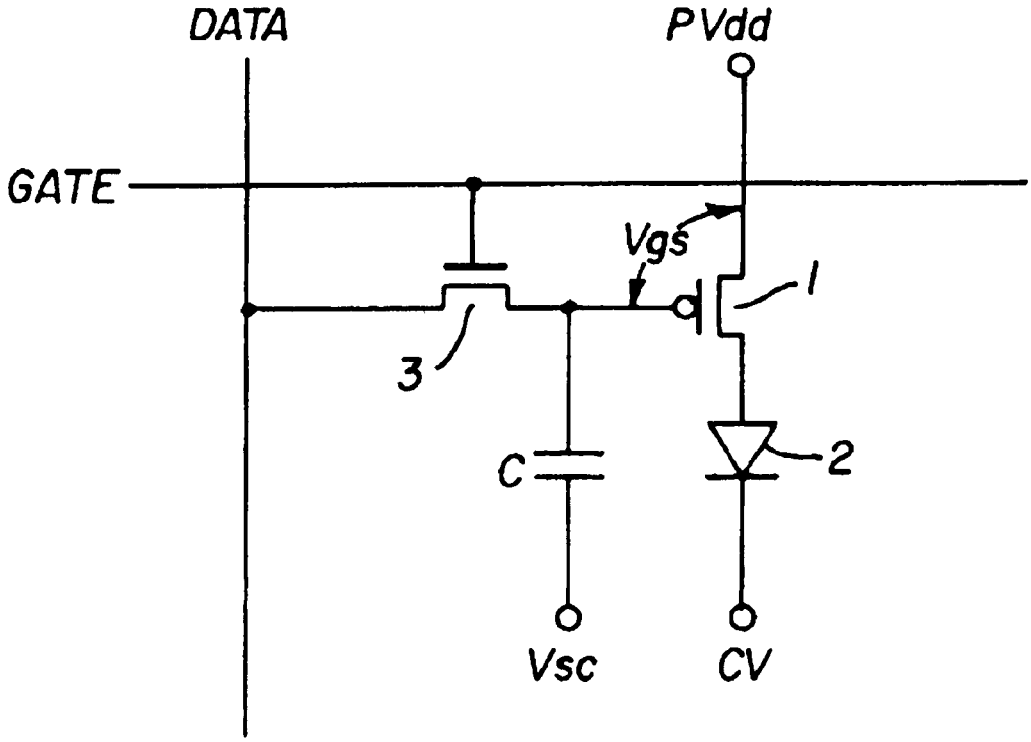
FIG. 1 (Prior Art)
FIG. 1 is a diagram showing a structure of a prior organic EL pixel circuit.
Figure 2:
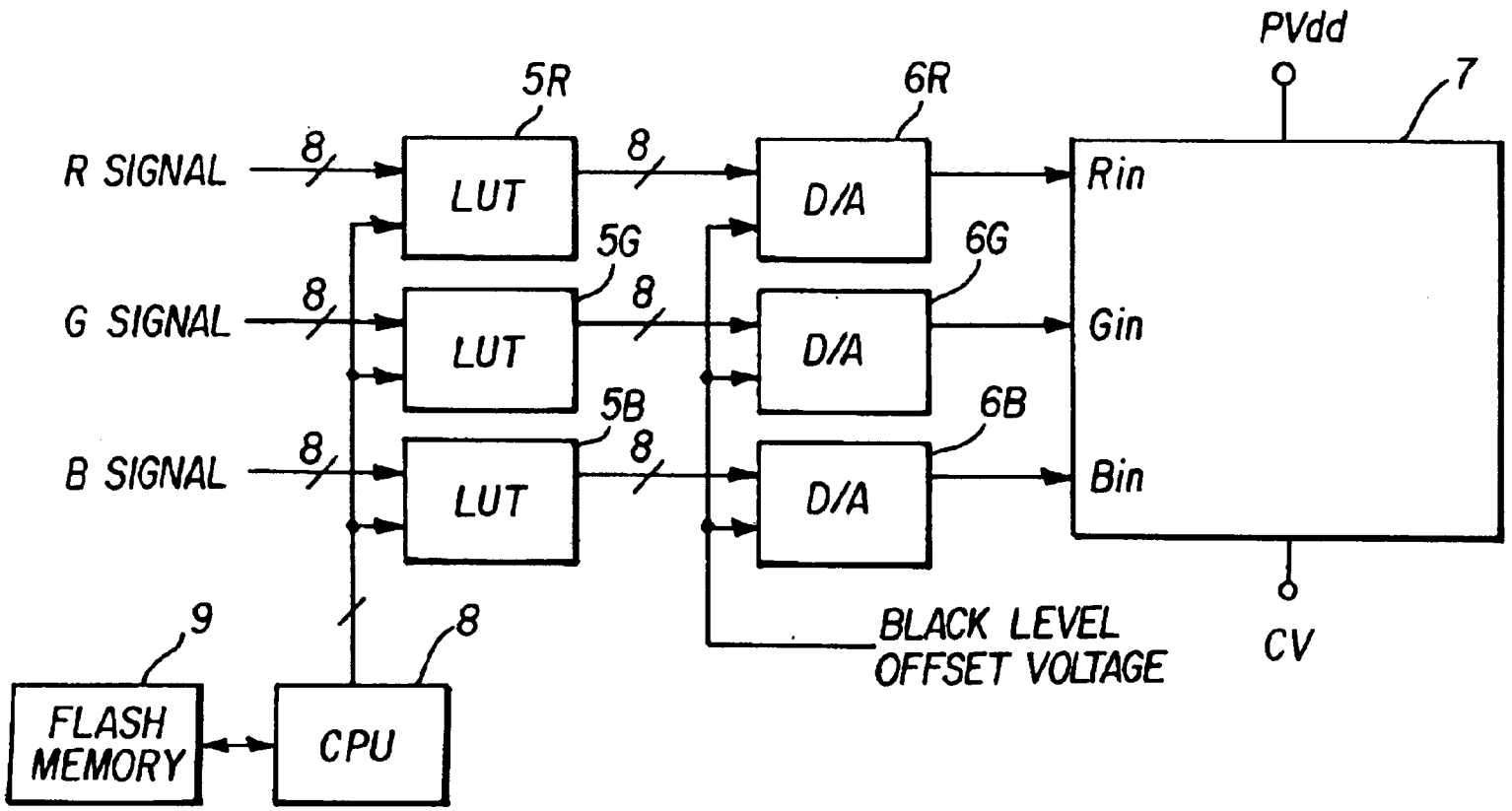
FIG. 2 (Prior Art)
FIG. 2 is a diagram showing the entire structure of an existing prior art organic EL display device.
Figure 7:
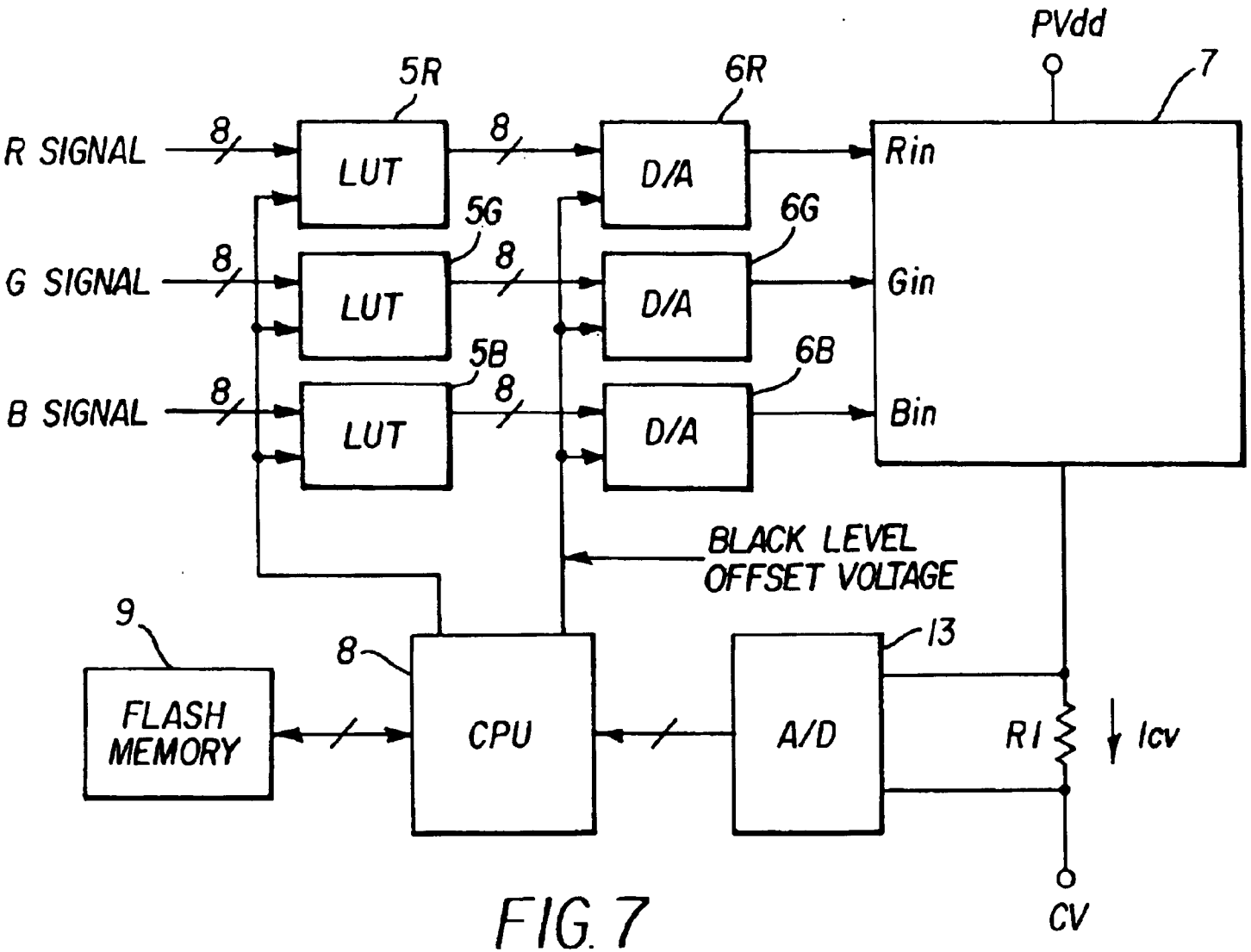
FIG. 7 is a diagram showing an embodiment of the organic EL display device according to an embodiment.

FIG. 7 is a block diagram schematically showing the structure of an embodiment of this invention. An organic EL display panel 7 has the pixel circuits shown in FIG. 1 arranged in a matrix in its inner display area. A vertical driver circuit and a horizontal driver circuit are arranged in the periphery of the display area and serve to control the application of a voltage to the data line Data and the gate line Gate.

The organic EL elements are divided for RGB (red, green, blue) respectively, and the same color pixels are arranged in a vertical direction. Specifically, a column of R, a column of G and a column of B are arranged sequentially in the perpendicular direction and repeatedly arranged sequentially in the horizontal direction, and the image signals of RGB are respectively applied to the data line Data corresponding to the respective columns. The organic EL elements themselves may emit light in respective colors R, G and B or may emit white light, which is changed into respective colors with respective color filters.

The image signals for the respective RGB colors are separately input to the display panel 7. Input terminals for the image signals are indicated by Rin, Gin and Bin. Input image signals, R signal, G signal and B signal are input to the input terminals Rin, Gin, Bin via lookup tables (LUT) 5R, 5G, 5B and D/A converters 6R, 6G, 6B. The display panel 7 is supplied from the power supply PVdd, which is connected to the sources of the individual drive TFTs 1. Meanwhile, the cathode of the organic EL element 2 of each pixel is taken from the display panel and connected to a cathode power supply CV. A current detection resistor R1 is disposed between the cathode and the cathode power supply CV, and a voltage corresponding to a total value of current flowing to all organic EL elements 2 formed on the display panel 7 is obtained at either end of the current detection resistor R1.

The voltage at each end of the resistor R1 is input to an A/D converter 13, converted into digital data and supplied to a CPU 8. A flash memory 9 is connected to the CPU 8. The flash memory 9 stores a black level adjustment voltage which is a basic black level offset voltage and also stores data concerning gamma curves of respective colors which are the basis for generating gamma compensation data concerning respective RGB colors to be written into the lookup table 5. It may be configured to store only a coefficient of the gamma curves or gamma compensation curves into the flash memory 9 so to produce an equation by a program executed by the CPU 8 or to store the equation itself into the flash memory 9.

When the system is activated, the CPU 8 reads data relating to the gamma curves or gamma compensation curves from the flash memory 9, generates data for the lookup tables relating to the gamma compensation curves, and writes into the lookup tables 5R, 5G, 5B. The CPU 8 also reads data about a black level adjustment voltage from the flash memory 9 and supplies it as the black level offset voltage to the D/A converters 6R, 6G; 6B. Thus, the RGB signals being input are gamma-compensated by the lookup tables 5R, 5G, 5B and converted into analog signals by the D/A converters 6R, 6G, 6B, and supplied to the display panel 7 with the black level adjusted.

The CPU 8 changes the black level offset voltage according to an amount of current Icv which is supplied from the A/D converter 13 and flows to the organic EL elements of the display panel 7. Thus, when the Vth of the drive TFT 1 becomes low because of an increase in temperature, the black level offset voltage can be decreased so as to prevent the drive current of the organic EL elements from becoming excessively large.

"Factory Setting"

Here, setting before shipping from a factory will be described. In a factory, the black level offset voltages and coefficients of an approximate expression of a compensating gamma are previously prepared by the procedure given below.

i) A table providing a linear relationship between input and output is written into the respective LUTs 5R, 5G, 5B by the CPU 8.

ii) A low black level offset voltage is set by the CPU 8 so as to enable output of adequately low voltages from the D/A converters 6R, 6G, 6B.

iii) The RGB input signals are determined to have a value 0.

iv) The G input signal is gradually increased while monitoring output data from the A/D converter 13, namely a total amount of current Icv flowing to the organic EL elements of the display panel 7, by the CPU 8. As the G input signal increases, the amount of current flowing to the organic EL elements increases so to increase output data (Dout) from the A/D converter 13, and when the output data Dout falls in a predetermined range (0<D out<D black), a value of output from the D/A converter 6G for G is determined as a black signal input level of the display panel 7. Here, the drive current Icv to the organic EL elements is substantially proportional to the luminance. Therefore, when the proportional coefficient of the element (luminous efficiency) is determined, the luminance can be known from the results obtained by measuring the amount of current Icv flowing to the organic EL elements without actually measuring it. In this embodiment, when the black signal input level is determined as described above, a value (output data Dout) of the current (Icv) flowing to the organic EL elements is monitored so that an optimum black level can be obtained depending on a state of emission by the organic EL elements according to the input image signal, and when the monitored value meets the above conditions, the input signal (D/A output) is determined as a black signal input level.

Figure 6:
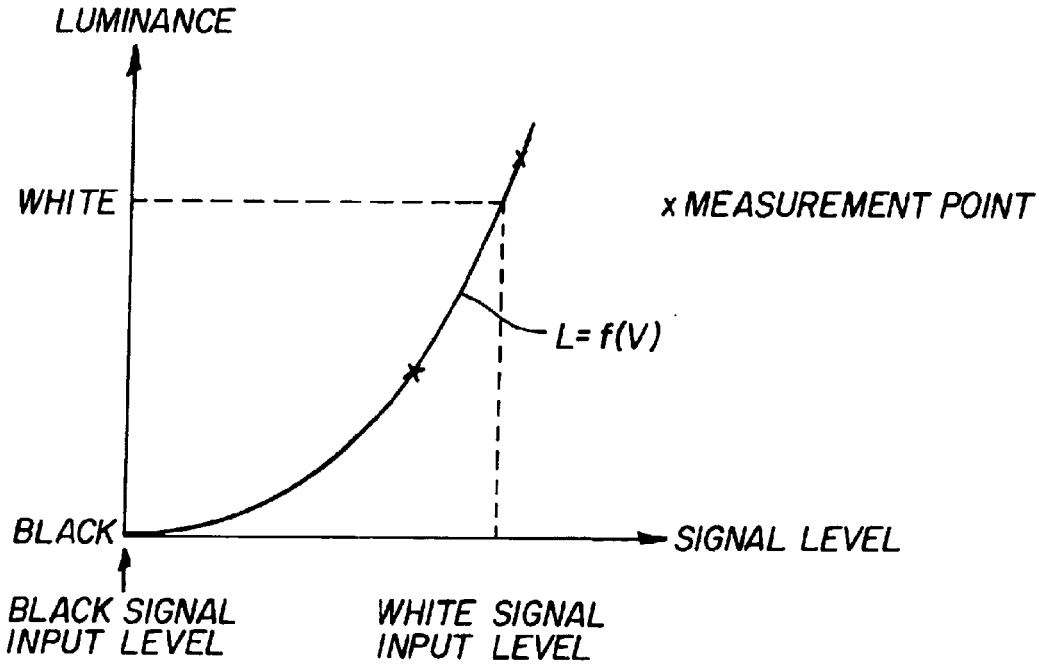
FIG. 6 is a diagram showing an equation which represents a relationship between a signal level and luminance.

The organic EL elements 2 often have a luminous amount of G larger than others because of the luminescent material used. Therefore, a signal for G may be used to measure the black level as described above. However, the measurement may be carried out separately for colors R, G, B, so as to set the black signal input voltage for the respective colors.

v) The black level offset voltage of each color is set by the CPU 8 so that the black signal input voltage determined in iv) is output when 0 is input to the D/A converter.

vi) L-V (luminance-input voltage) characteristics of several points are measured for RGB respectively by the measuring system of FIG. 3. Thus, there is obtained a relationship shown in, for example, FIG. 6.

vii) An expression, L=f(V), of the curve passing through the obtained points and the origin point (black level) is created as shown in FIG. 6. An expression, V=g(L), of the reverse characteristic of gamma is obtained from the former to determine coefficients a, b, c, d. . . of this expression.

For example, the coefficients a and b which meet the expression below are determined for RGB respectively.

$$L=f(V)=axV^{b}$$

viii) From the above expression, the reverse characteristic of gamma of the panel is determined as indicated below.

$$V=g(L)=AxL^{B}$$

Values A and B are stored in the flash memory 9 which is a nonvolatile memory. Here, $A=(1/a)^{(1/b)}$, and B=(1/b).

Thus, necessary data is written into the flash memory 9.

The expression for the characteristics is not limited to that described above but may be another expression.

"Initialization"

When the system is activated, the black level offset voltage is set by the CPU 8 into the D/A converters 6R, 6G, 6B according to the black level adjustment voltage stored in the flash memory 9 as described above. The CPU 8 uses the coefficients A, B in the flash memory 9 to create table data from the expression $V=AxL^{B}$ and writes the table data into the LUTs 5R, 5G, 5B.

"Adjustment of Black Level in Use"

In this embodiment, the black level offset voltage is adjusted at the time of use according to the total current of the organic EL elements detected by the current detection resistor R1 as described above. This procedure will be described below.

Figure 8:
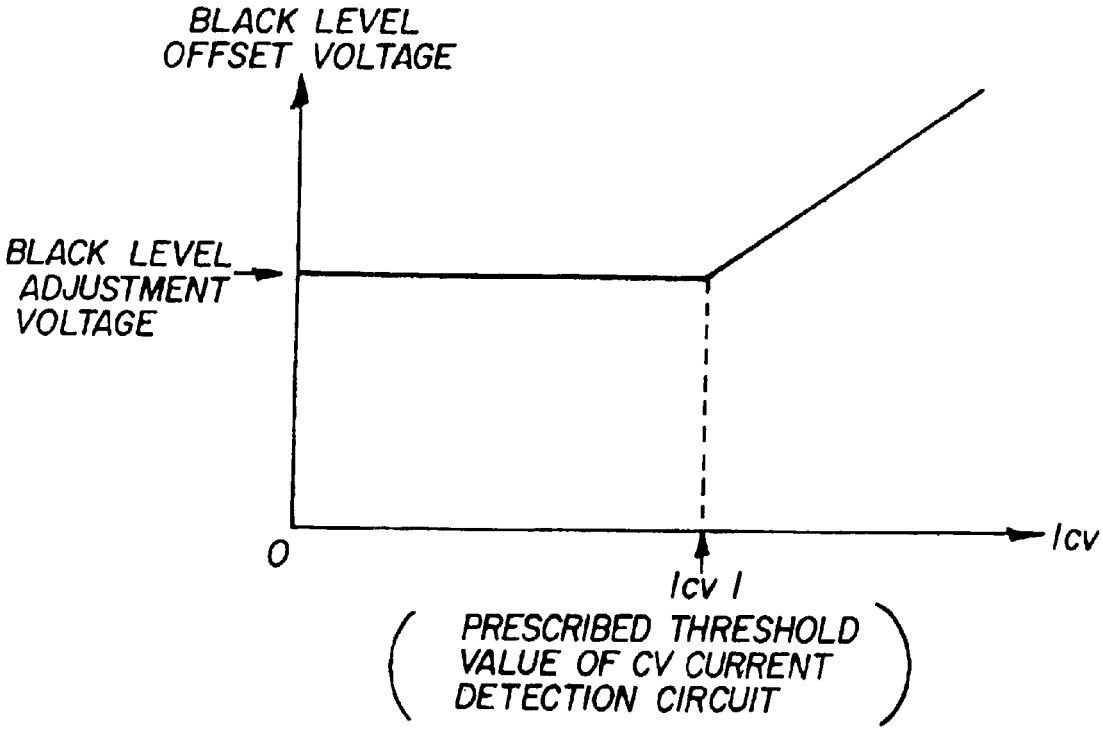
FIG. 8 is a diagram showing a relationship between a total current and a black level offset voltage.
Figure 9:
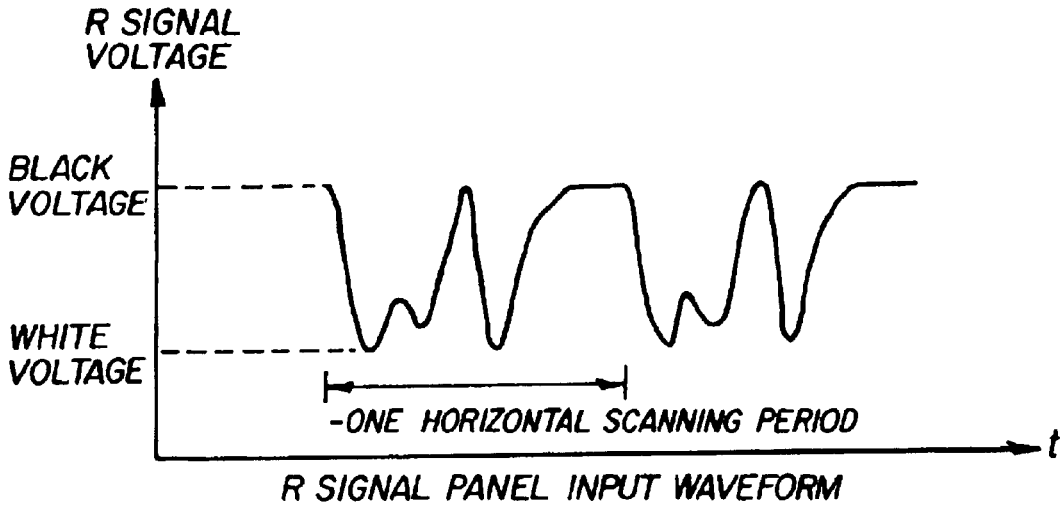
FIG. 9 is a diagram showing an example of an input image signal to a display panel.

The voltages at both ends of the current detection resistor R1 are supplied as digital data to the CPU 8 by the A/D converter 12. The CPU 8 determines whether or not the current Icv (total current flowing to the organic EL elements of the organic EL panel 7) flowing to the current detection resistor R1 has reached a prescribed threshold value Icv1, and when it is equal to or below the threshold value as shown in FIG. 8, outputs the black level offset voltage as it is. When the current Icv exceeds the threshold value Icv1, a signal which increases according to the current Icv is supplied as a black level offset voltage to the D/A converters 6R, 6G, 6B. Thus, the black level of the image signal is shifted as shown in FIG. 9

A gate application voltage of the p-channel type drive TFT 1 is shifted upward as Icv becomes larger. Therefore, even when the threshold voltage Vth of the drive TFT 1 becomes small due to the effect of temperature or the like, it can be compensated by changing the black level offset voltage. Specifically, the predetermined value of the black level is changed to make black more black with the increase in current Icv. As a result, current consumption (Cv current) of the organic EL display panel 7 does not exceed the predetermined value, and the prominence of black due to a change in temperature is limited.

"Another Embodiment"

The black level is determined commonly among colors RGB in the above-described embodiment, but a different value can be determined for each color individual measurement.

As described above, the drive current Icv of the organic EL element and the luminance are substantially proportional to each other. Therefore, when the proportional coefficient (luminous efficiency) is known, a current can be measured instead of measuring the luminance with a luminance meter, and the luminance can be calculated. The drive current Icv of the organic EL elements can be measured by using the current detection resistor R1 shown in FIG. 7 as described above. Specifically, the luminance can be calculated from the voltages at both ends of R1 according to the structure shown in FIG. 7, and a gamma compensation curve can be created according to the drive current Icv of the organic EL elements without using a luminance meter.

Specifically, before shipping from the factory, the drive current Icv passed to the organic EL elements when plural levels of input image signals are supplied for each of R, G, B is measured, and the luminance (luminous amount) of the organic EL element according to the plural input image signal levels is calculated from the measured current value according to the known (previously checked) luminous efficiency of organic EL elements. Thus, the relationship shown in FIG. 6 is determined from the drive current value without actually measuring the luminance. The obtained relationship, namely the approximate expression (or a coefficient of a predetermined approximate expression) indicating the relationship between the luminance determined from the drive current and the input signal voltage, is stored in the flash memory 9 or the like. It may be used at the time of initialization or when actually used.

As described above, according to the present invention, the table data generation means generates table data on the basis of data relating to the equation which is stored in the storage means and writes the data in the lookup table. Therefore, it is not necessary to store all the table data, and the storage means is not required to have a large capacity. By virtue of the equation, the gamma compensation curves can be created with a few measuring points, and it becomes easy to perform setting at a factory or the like.

In general, while there have been described that what are at present considered to be preferred embodiments of the invention, it is to be understood that various modifications may be made thereto, and it is intended that the appended claims cover all such modifications as fall within the true spirit and scope of the invention.

PARTS LIST

1 drive TFT
2 EL element
3 channel type selection
7 display panel
8 CPU
9 flash memory
11 drive circuit
12 luminance meter
13 A/D converter
C retention capacitor
CV cathode power supply
Dout output data
Icv current
PVdd power supply
R1 current detection resistor
5R, 5G, 5B lookup tables (LUT)
6R, 6G, 6B D/A converters
Rin, Gin, Bin input terminals
Vsc capacitor power supply
Vgs gate-to-source voltage
Vth threshold voltage

What is claimed is:

1. An organic EL display device which displays by individually controlling an amount of current of organic EL elements, which are arranged in a matrix, according to an input image signal, comprising:

a lookup table for storing gamma compensation data for compensating an image signal;

storage means for storing an equation for performing gamma compensation of the input image signal; and table data generation means for generating table lookup data and storing such data in the lookup table on the basis of the equation stored in the storage means, and wherein the table data generated by the table data generation means is stored in the lookup table by an initialization operation to perform gamma compensation of the input image signal.

2. The organic EL display device according to claim 1, wherein the table data generation means comprises:

a nonvolatile memory for storing a coefficient of the equation; and processing means for generating the equation by using a coefficient stored in the nonvolatile memory.

3. The organic EL display device according to claim 1 wherein the equation stored in the table data storage means is obtained by making the organic EL panel emit light in an amount according to input image signal levels of a plurality of stages, detecting the amount of emitted light to determine a relationship between the input image signal level and the amount of emitted light, and calculating an approximate expression indicating the determined relationship or only a prescribed coefficient of the approximate expression according to the determined result.

4. The organic EL display device according to claim 1 wherein the equation stored in the table data storage means is obtained by supplying input image signals of plural stages to make the organic EL elements emit light so to measure a drive current passing to the elements; determining, from the measured current value, a relationship between the input image signal level and the amount of emitted light of the organic EL elements according to a luminous efficiency of the organic EL elements; calculating, according to the determined relationship, an approximate expression indicating the relationship between the input image signal and the amount of emitted light of the organic EL elements or a coefficient of the prescribed approximate expression; and determining from the obtained approximate expression or coefficient.

5. The organic EL display device according to claim 1 further comprising total current detection means for detecting total current flowing to all the organic EL elements arranged in a matrix, wherein:

an offset voltage which offsets the input image signal is determined according to the total current detected by the total current detection means so as to provide a voltage to make a current start passing to the organic EL elements according to a black level of the input image signal.

* * * * *